US007628289B1

(12) United States Patent
Boyd

(10) Patent No.: US 7,628,289 B1
(45) Date of Patent: Dec. 8, 2009

(54) TURF ANCHOR

(76) Inventor: David L. Boyd, P.O. Box 477, Magnolia, OH (US) 44643

( * ) Notice: Subject to any disclaimer, the term of this patent is extended or adjusted under 35 U.S.C. 154(b) by 191 days.

(21) Appl. No.: 11/880,570

(22) Filed: Jul. 23, 2007

Related U.S. Application Data

(60) Provisional application No. 60/836,790, filed on Aug. 10, 2006.

(51) Int. Cl.
*B65D 25/20* (2006.01)
*B65D 90/12* (2006.01)
*B65D 25/24* (2006.01)

(52) U.S. Cl. ..... 220/630; 220/484; 220/629; 220/908

(58) Field of Classification Search ..... 220/629, 220/630, 475, 484, 908
See application file for complete search history.

(56) References Cited

U.S. PATENT DOCUMENTS

| | | | | | |
|---|---|---|---|---|---|
| 606,100 | A | * | 6/1898 | Thompson | 220/23.88 |
| 733,984 | A | * | 7/1903 | Lucas | 248/148 |
| 822,793 | A | * | 6/1906 | Weber | 220/475 |
| 836,555 | A | * | 11/1906 | Birnie | 220/293 |
| 1,464,801 | A | * | 8/1923 | Beers | 220/493 |
| 1,493,948 | A | * | 5/1924 | Apple | 220/491 |
| 1,576,139 | A | * | 3/1926 | Schneider | 47/41.01 |
| 1,921,208 | A | * | 8/1933 | Seruton | 248/147 |
| 2,372,073 | A | * | 3/1945 | Flournoy | 248/149 |
| 2,906,061 | A | * | 9/1959 | Carlson | 47/41.01 |
| 3,575,284 | A | * | 4/1971 | Holt | 206/425 |
| 4,072,286 | A | | 2/1978 | Foncannon | |
| 4,084,701 | A | | 4/1978 | White | |
| 4,339,048 | A | * | 7/1982 | McMillen et al. | 220/475 |
| 4,513,938 | A | | 4/1985 | Seymour | |
| 5,058,315 | A | | 10/1991 | Wagner | |
| 5,456,203 | A | | 10/1995 | Oglesby, Jr. et al. | |
| 5,462,213 | A | * | 10/1995 | Watt | 224/155 |
| 5,580,015 | A | | 12/1996 | Baker | |
| 2002/0121580 | A1 | | 9/2002 | Grady et al. | |

* cited by examiner

*Primary Examiner*—Anthony Stashick
*Assistant Examiner*—Niki M Eloshway
(74) *Attorney, Agent, or Firm*—Sand & Sebolt

(57) ABSTRACT

An anchoring mechanism for anchoring an outdoor trash can or other item to the ground includes a base mountable on the trash can and an anchor which is movable between a raised position and a lowered anchoring position. A reinforcing plate may be used inside the trash can to help secure the anchoring mechanism thereon. A foot press member is provided on the anchor to facilitate the pressing of the anchor into the ground. The anchoring mechanism is configured to prevent the trash can when empty from blowing around in fairly high winds and helps prevent the tipping of filled trash cans.

23 Claims, 7 Drawing Sheets

TURF ANCHOR

CROSS REFERENCE TO RELATED APPLICATION

This application claims priority from U.S. Provisional Application Ser. No. 60/836,790 filed Aug. 10, 2006; the disclosure of which is incorporated herein by reference.

BACKGROUND OF THE INVENTION

1. Technical Field

The present invention relates generally to an anchoring device for temporarily anchoring an object to the ground. More particularly, the invention relates to an anchoring device for anchoring an outdoor trash can to the ground. Specifically, the present invention relates to such an anchoring device which is mounted adjacent the bottom of the trash can and includes an anchor which may be pressed by a person's foot into the ground to secure the trash can to the ground.

2. Background Information

It is well known that outdoor trash cans may tip over for a variety of reasons and also may be blown about in windy climates. The tipping of trash cans may result in the spilling of and spreading of trash throughout a neighborhood. When the trash cans are empty and susceptible to being blown about, they may also be lost or damaged and furthermore may present a danger to vehicles traveling on roads onto which the trash cans have been blown. Other outdoor items are also subjected to being blown about or tipped over.

U.S. Pat. No. 4,072,286 granted to Foncannon describes a garbage can support utilizing an auger type anchor which is rotated to secure the trash can support to the ground. A frame work is connected to the auger including an adjustable strap which encircles the bottom of the trash can and is movable between a loosened and tightened securing position to secure the trash can. U.S. Pat. No. 4,513,938 granted to Seymour describes a support column having several telescoping sections one of which is permanently secured underground with the other sections telescoping in a vertical manner so that the upper section is connected to a trash can adjacent its upper end. US Patent Application Publication 2002/0121580 of Grady et al. describes a mailbox pole which is vertically adjustable and includes a pair of hooks extending outwardly therefrom to respectively support a trash can and its lid. U.S. Pat. No. 4,084,701 granted to White also describes a trash can securing device which is substantially more complicated than those discussed thus far and includes a horizontal base on which the trash cans are seated with multiple parts for securing both the trash can and the lid.

BRIEF SUMMARY OF THE INVENTION

The present invention provides an anchoring mechanism for use with an outdoor item having a lower end adapted to sit on the ground, the apparatus comprising: a base; a mounting mechanism on the base adapted to mount the base on the outdoor item adjacent its lower end; and an anchor mounted on the base and movable between a raised position in which the anchor is adapted to be removed from the ground and a lowered anchoring position in which the anchor is adapted to be inserted into the ground to secure the outdoor item to the ground.

The present invention also provides an apparatus comprising: an outdoor trash can; a lower end on the trash can; an anchor mounted on the trash can and movable relative to the trash can between a raised position in which the anchor is adapted to be removed from the ground and a lowered anchoring position in which the anchor extends below the lower end and is adapted to be inserted into the ground to secure the trash can to the ground.

DETAILED DESCRIPTION OF THE INVENTION

Figure 1:
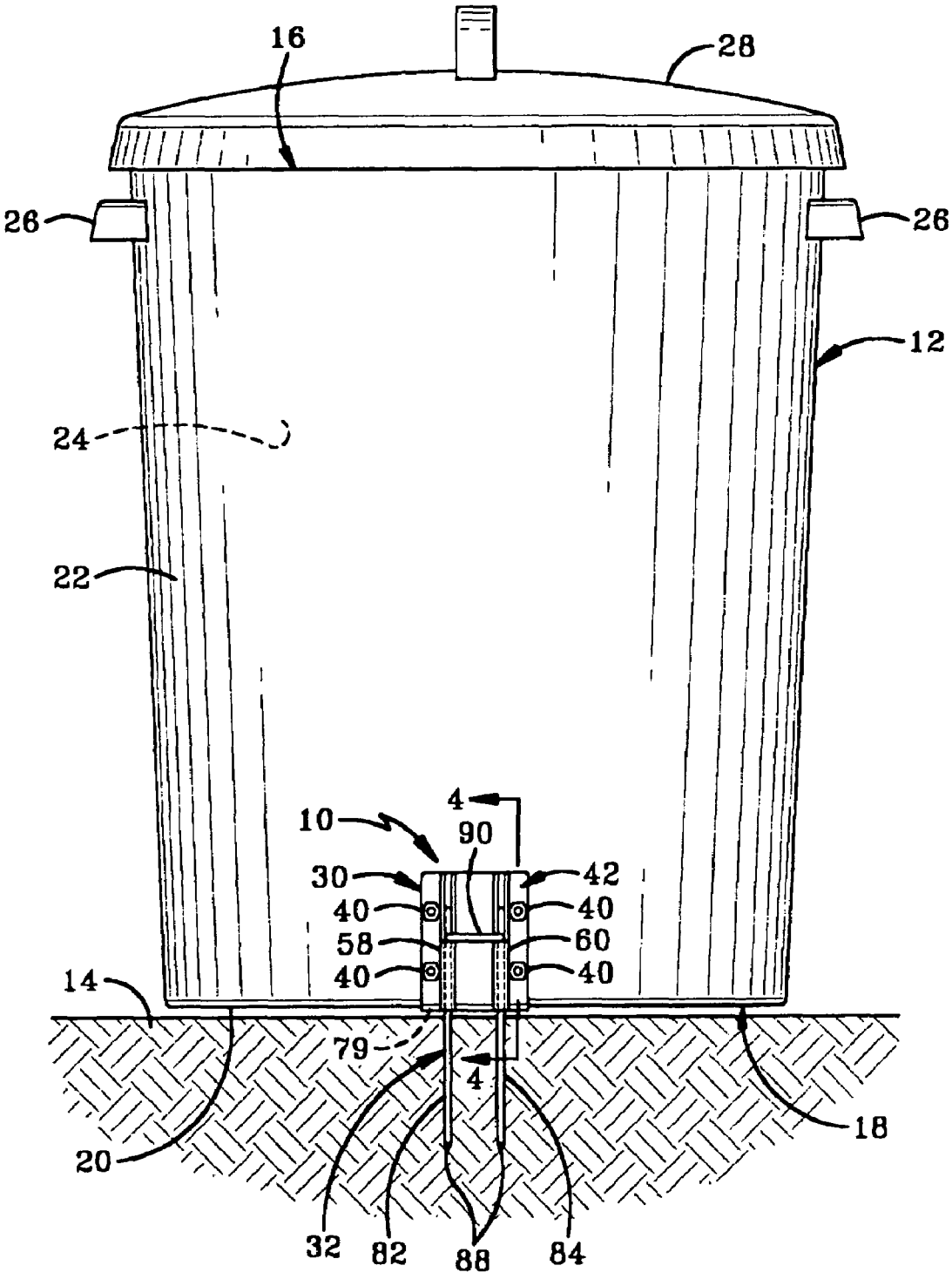
FIG. 1 is a front elevational view of the first embodiment the anchoring device of the present invention mounted on the trash can and shown in the anchoring position.
Figure 3:
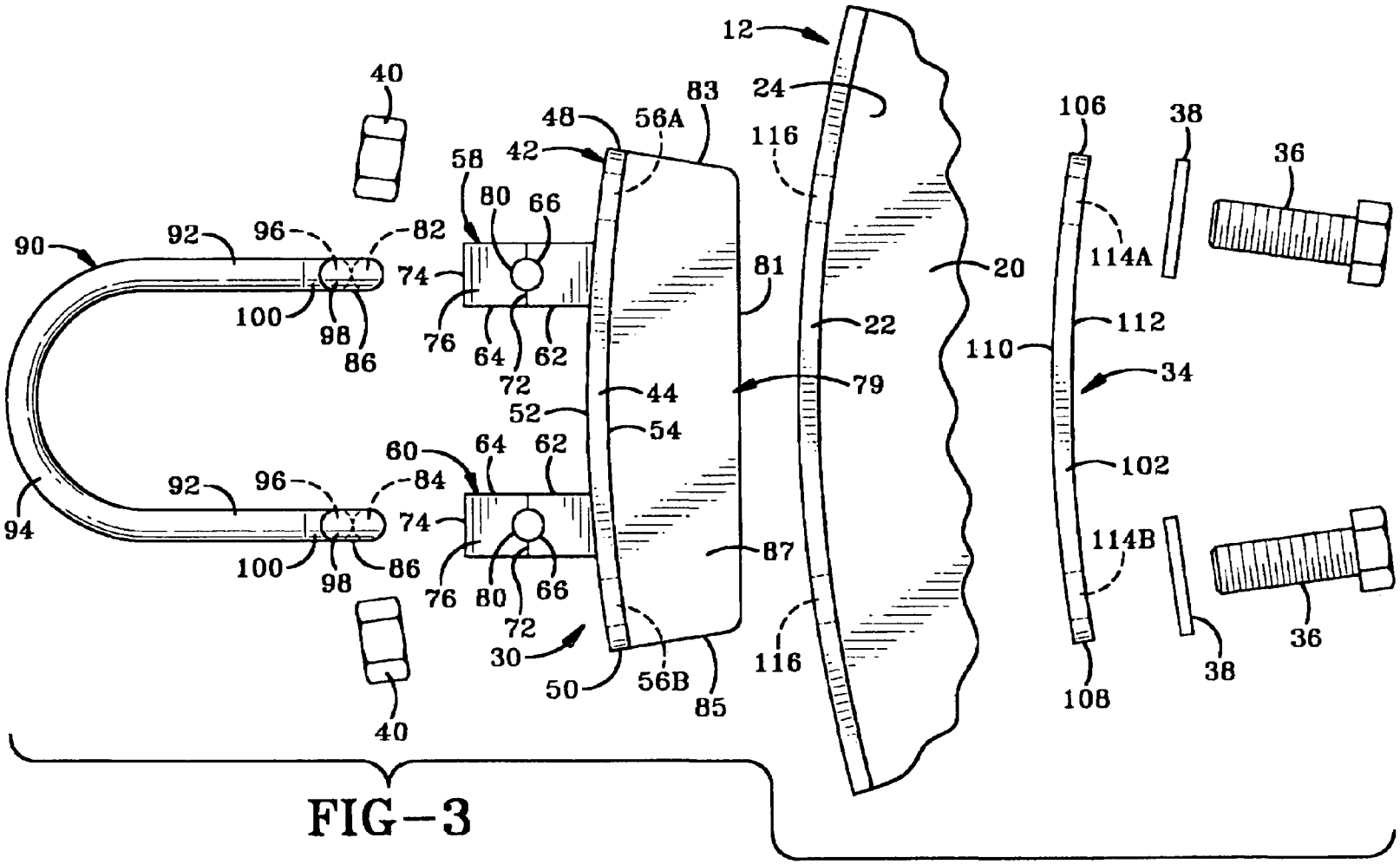
FIG. 3 is an exploded top plan view of the anchoring device and a portion of the trash can.
Figure 4:
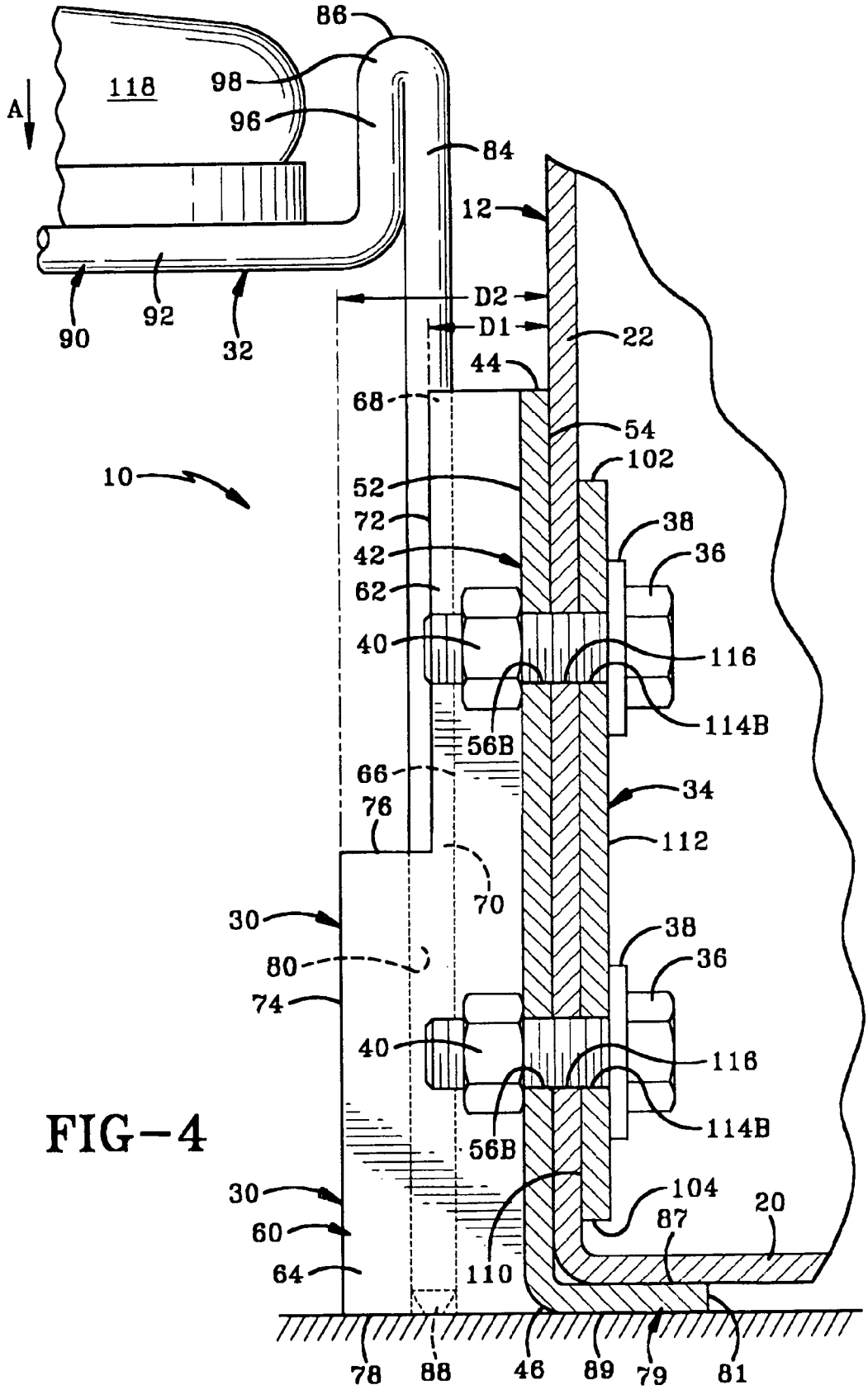
FIG. 4 is a sectional view from the side of the anchoring device mounted on the trash can in the raised position showing a lower portion of the trash can and a shoe preparing to press the anchor into the ground.
Figure 5:
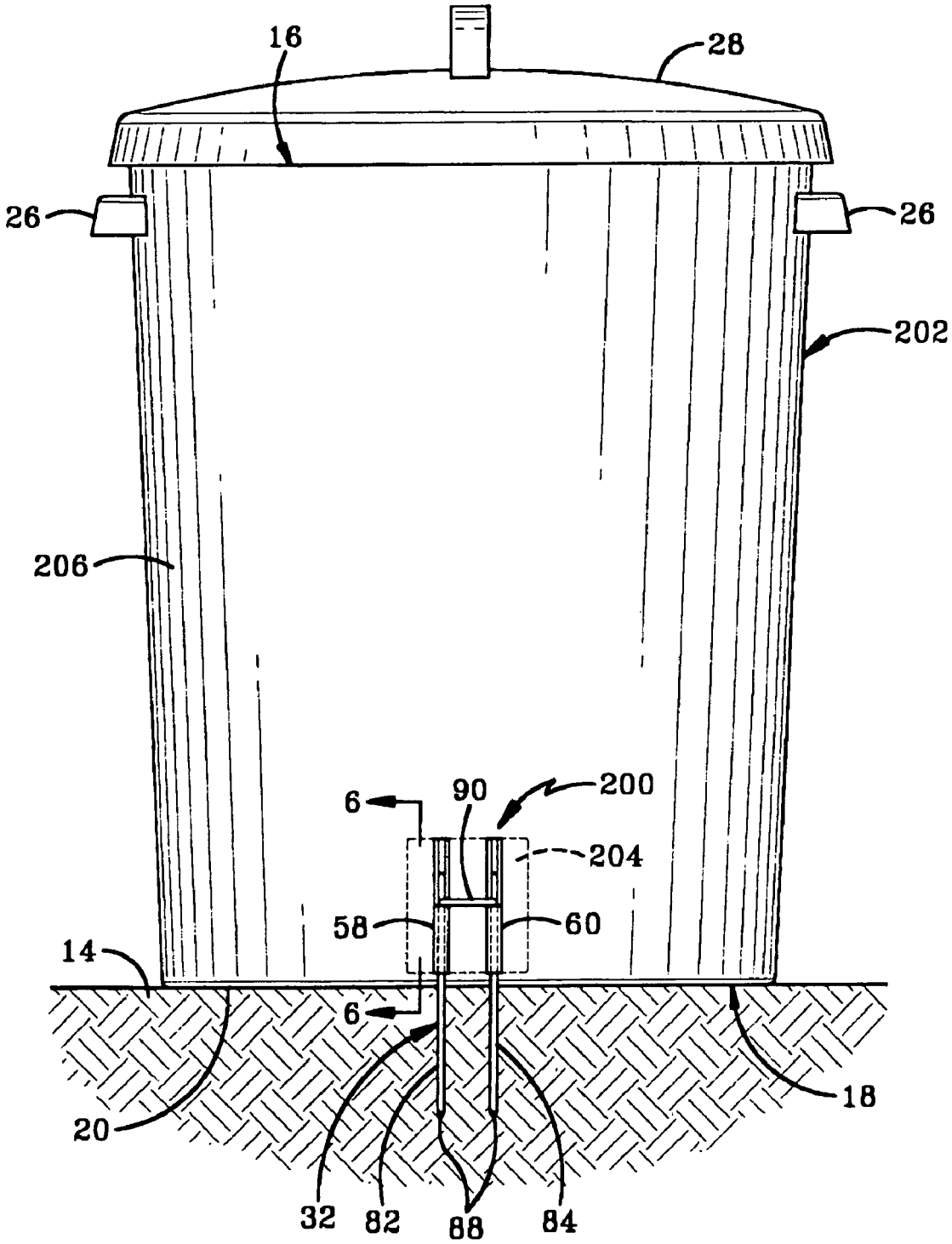
FIG. 5 is a front elevational view of the second embodiment of the anchoring device mounted on a trash can.

A first embodiment of the anchoring device of the present invention is shown generally at 10 in FIGS. 1-4 and a second embodiment of the anchoring device is shown generally at 200 in FIG. 5. Anchoring device 10 is shown in FIG. 1 mounted on a trash can 12 for temporarily securing trash can 12 or another outdoor item to the turf or ground 14. Trash can 10 includes upper and lower ends 16 and 18, a generally horizontal bottom wall 20 at lower end 18 and an annular sidewall 22 connected to and extending upwardly from bottom wall 20 to upper end 16. Sidewall 22 is typically cylindrical or frustoconical although other shapes are of course known. Bottom wall 20 and sidewall 22 define therewithin a trash-receiving interior chamber 24. A pair of handles 26 extends outwardly opposite one another from sidewall 22 adjacent upper end 16. A lid 28 is typically provided to help secure trash within chamber 24. As shown in FIG. 1, anchoring device 10 is mounted on sidewall 22 adjacent lower end 18.

Figure 2A:
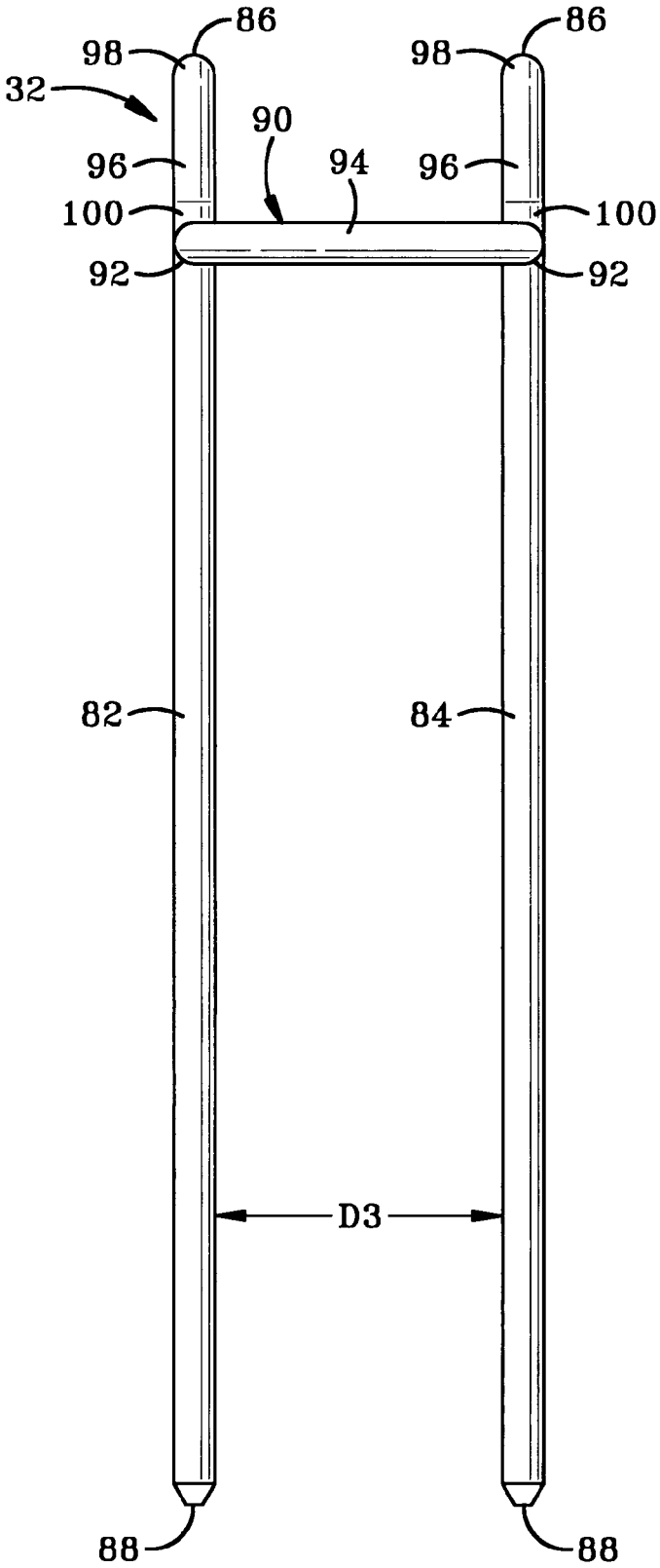
FIG. 2A is a front elevational view of the anchor.
Figure 2C:
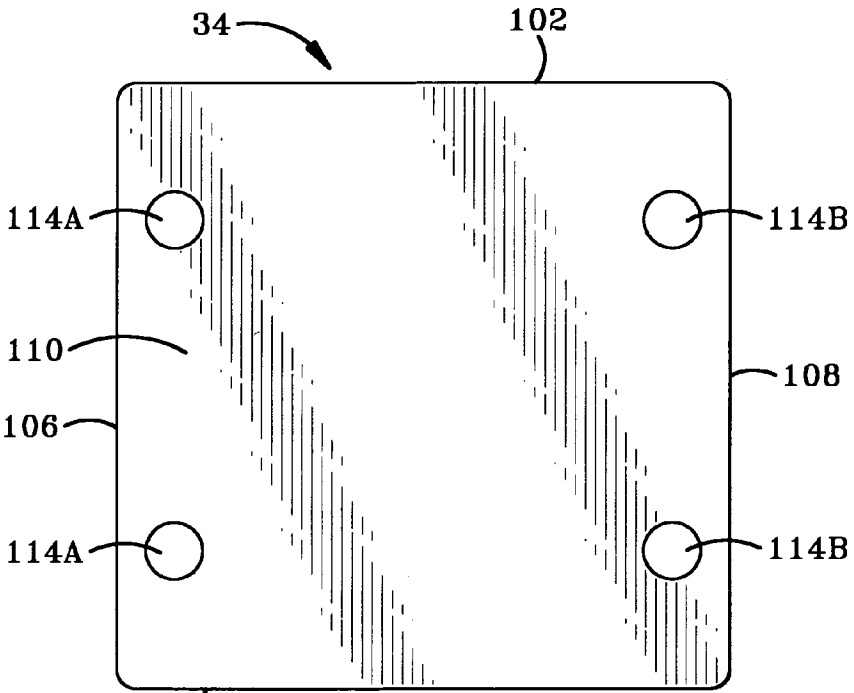
FIG. 2C is a front elevational view of the reinforcing plate.
Figure 2B:
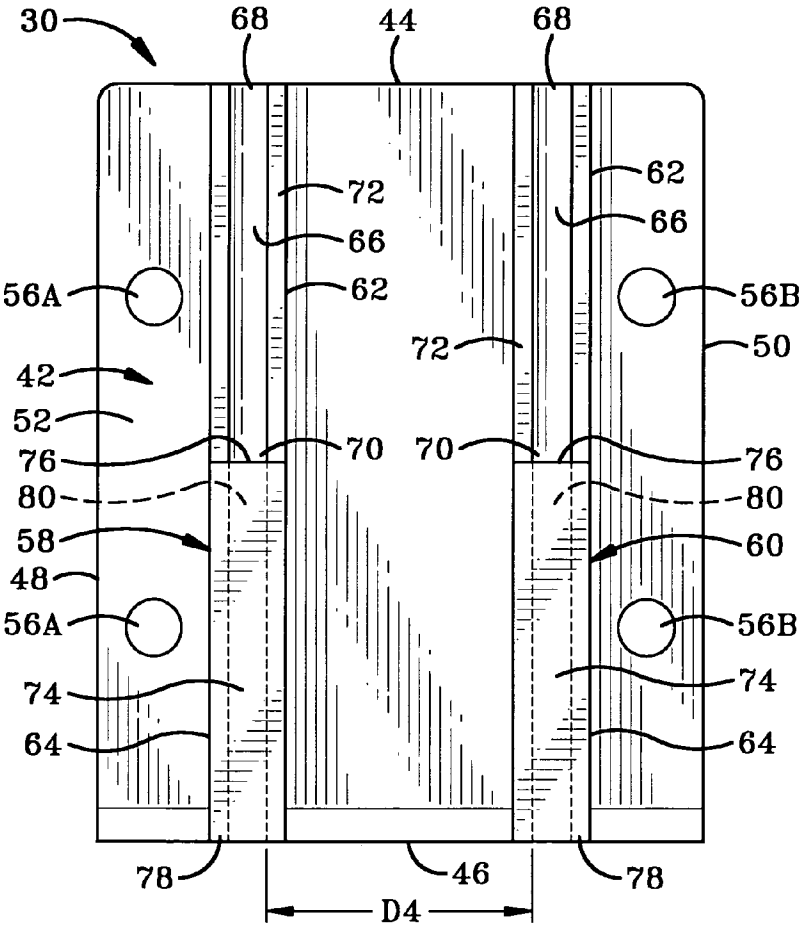
FIG. 2B is a front elevational view of the base.

Referring now to FIGS. 2-3, device 10 is described now in further detail. Device 10 includes a rigid base 30, an anchor 32, a reinforcing member in the form of a reinforcing plate 34 or washer 38 and a plurality of fasteners comprising a plurality of bolts 36 and nuts 40 which threadedly engage bolts 36. These fasteners serve to secure base 30 to reinforcing plate 34 so that device 10 may be secured to trash can 12. Bolts 36 may be permanently fixed to plate 34 by welding or another means so that plate 34 and bolts 36 form an integral unit. This simplifies assembly by eliminating awkward manipulation of bolts 36 relative to plate 34 and by eliminating the need for tools to hold bolts 36 when tightening nuts 40 thereon.

Referring to FIGS. 2B and 3, base 30 is typically formed of metal or another rigid material such as certain plastic materials. Base 30 includes a generally flat mounting plate 42 having a top edge 44, a bottom edge 46 and first and second opposed lateral edges 48 and 50 extending therebetween. Plate 42 has front and rear sides 52 and 54. Although sides 52 and 54 may be flat, plate 42 in the exemplary embodiment is curved or bowed slightly so that front side 52 is a convexly curved surface and rear side 54 is a concavely curved surface adapted to matingly engage the convexly curved outer surface of sidewall 22 of trash can 12. Thus, when viewed from above (FIG. 3) or below, mounting plate 42 is curved between first and second edges 48 and 50. Thus, top and bottom edges 44 and 46 and front and rear sides 52 and 54 are curved between edges 48 and 50 while edges 48 and 50 are straight as viewed from the side. Four holes which extend generally horizontally are formed in mounting plate 42 extending from the front side 52 to rear side 54. More particularly, these holes include a pair of holes 56A adjacent first edge 48 and vertically spaced from one another and a pair of holes 56B adjacent second edge 50 and vertically spaced from one another and respectively at the same height as holes 56A.

First and second vertically extending and substantially parallel rails 58 and 60 are connected to extend outwardly in the forward direction from front side 52 of mounting plate 42. Each of rails 58 and 60 includes an upper segment 62 and a lower segment 64 connected to upper segment 62 and extending downward therefrom. A pair of vertically extending parallel grooves 66 are formed respectively in upper segments 62 and extend the entire vertical length of said upper segments 62. Each groove has an upper end 68 and lower end 70 and in the exemplary embodiment has a semi-cylindrical cross-section. Each upper segment 62 has a front surface 72 so that surface 72 and front side 52 define therebetween a normal distance D1 (FIG. 4) which is the thickness of upper segments 62 as measured horizontally from front to back. Each lower segment 64 likewise has a front surface 74 so that front surface 74 and front side 52 define therebetween a normal distance D2 (FIG. 4) which is larger than distance D1 and represents the horizontal thickness from front to back of each lower segment 64. Each lower segment 64 has an upper end 76 connected to the lower end of the respective upper segment 62 and extends downwardly therefrom to a lower end 78 which is coincidental with bottom edge 46 of plate 42. A pair of parallel vertically elongated through holes 80 are formed respectively in lower segments 64 extending from upper ends 76 to lower ends 78. Holes 80 are respectively vertically aligned with and parallel to grooves 66 with the upper ends of holes 80 communicating with the lower ends 70 of grooves 66. Upper segment 62 and lower segment 64 have approximately the same height and thus each represents approximately one half the height of mounting plate 42 although this may vary. Thus, the exemplary embodiment of each groove 66 has a vertical height or length which is substantially the same as each hole 80 so that each groove 66 and hole 80 likewise represent about one half the height of plate 42 and one half the height of the respective rail 58 or 63.

A flange 79 (FIGS. 3 and 4) is connected to plate 42 adjacent bottom edge 46 and extends rearwardly from rear side 54 to a terminal rear end or edge 81. Flange 79 has first and second lateral edges 83 and 85 respectively adjacent first and second edges 48 and 50 of plate 42. Flange 79 further has a top surface 87 and a bottom surface 89. Flange 79 is typically in the form of a flat plate which extends horizontally so that top surface 87 faces upwardly and is intended to help support trash can 12 when bottom wall 20 or lower end 18 of trash can 12 is seated thereon. Bottom surface 89 faces downwardly and typically abuts ground 14 when used with trash can 12.

In the exemplary embodiment, anchor 32 (FIGS. 2A and 3) is formed of a single metal rod which has been bent into the configuration shown and is thus formed as an integral one-piece member. This configuration is very cost effective although other configurations may be used. Anchor 32, like base 30, is preferably formed of a non-rusting material such as stainless steel, plastic or other suitable material. Rust would not only deteriorate these elements, but inhibit the sliding movement of anchor 32. Anchor 32 includes first and second vertically extending spikes 82 and 84 each having an upper end 86 and a lower terminal end 88 which is tapered downwardly and inwardly somewhat to facilitate insertion into the ground. When spikes 82 and 84 are not inserted in holes 80 (FIG. 2A), they are angled slightly relative to one another so that they are not quite parallel to one another. Thus, for example, spikes 82 and 84 adjacent lower ends 88 define therebetween a normal horizontal distance D3 (FIG. 2A) which is slightly different from a horizontal normal distance D4 (FIG. 2B) between holes 80 and the distance between spikes 82 and 84 adjacent upper ends 86. Anchor 32 is preferably formed of a metal which is rigid but has some spring to it to allow for some flexing of spikes 82 and 84 to change distance D3 to equal distance D4 to make spikes 82 and 84 parallel (FIG. 1) for insertion into holes 80. The spring bias of spikes 82 and 84 toward the position of FIG. 2A creates a suitable frictional engagement of spikes 82 and 84 with lower segments 64 when disposed in holes 80 so that anchor 32 is held in place in the raised position shown in FIG. 4 solely by this frictional engagement. Spikes 88 are thus slidably received within respective grooves 66 and holes 80 to allow for a substantially vertical sliding movement between the lowered anchoring position of FIG. 1 and the raised non-securing position of FIG. 4. Anchor 32 further includes a U-shaped foot press member 90 which extends outwardly in the forward direction from spikes 82 and 84 substantially perpendicularly to said spikes in a horizontal direction. Foot press member 90 includes a pair of horizontally extending legs 92 which are spaced form one another and connected to an intervening arcuate base 94. Foot press member 90 is connected to each of spikes 82 and 84 by a respective pair of intermediate reinforcing segments 96 which extend vertically and respectively abut spikes 82 and 84 adjacent upper ends 86 thereof. Each segment 96 is connected to a respective one of spikes 82 and 84 adjacent upper end 86 by a first 180-degree bend 98. Segment 96 is likewise connected to a respective leg 92 by a second 90-degree bend 100.

Reinforcing plate 34 (FIGS. 2C and 3) is typically formed of metal or another rigid material such as a suitable plastic and in the exemplary embodiment mimics the configuration of plate 42. Thus, plate 34 is a substantially rectangular plate having a top edge 102, a bottom edge 104, first and second straight lateral edges 106 and 108, a front side 110 and a rear side 112. Plate 34 is generally flat although in the exemplary embodiment is curved somewhat in the same manner as described with regard to plate 42. Thus, plate 34 is curved as viewed from above (FIG. 3) with top and bottom edges 102 and 104 being curved between edges 106 and 108, front surface 110 being convexly curved from edge 106 to edge 108 and surface 112 being concavely curved from edge 106 to edge 108. The convexly curved front side 110 thus matingly engages the concavely curved inner surface of sidewall 22 of trash can 12. A pair of horizontally extending holes 114A are formed in plate 34 adjacent lateral edge 106 extending from side 110 to side 112. Likewise, a pair of holes 114B are formed in plate 34 adjacent edge 108 extending from side 110 to side 112. Holes 114A are aligned respectively with holes 56A and holes 114B are aligned respectively with holes 56B so that bolts 36 extend through a respective one of holes 114 and 56 when device 10 is assembled and mounted on trash can 12.

As shown in FIG. 4, device 10 is mounted on trash can 12 adjacent lower end 18 thereof. In the embodiment shown, device 10 is configured to be suitable as a retrofit or after market device which may be attached to standard trash cans. In order to do this, holes 116 are formed in sidewall 22 of trash can 12 respectively aligned with holes 56 and holes 114 so that bolts 36 pass through aligned holes 56, 116 and 114 and are secured by nuts 40. Washers 38 may be used instead of plate 34. When mounted on trash can 12, base 30 is disposed outside trash can 12 with rear surface 54 and plate 42 abutting the outer surface of sidewall 52 preferably in a mating fashion. The heads of bolts 36 and reinforcing plate 34 are disposed within interior chamber 24 of trash can 12 with front surface 110 abutting the inner surface of sidewall 22 also preferably in a mating fashion. Sidewall 22 is thus sandwiched between plates 42 and 34. Alternately, washers 38 may abut the inner surface of sidewall 22 when plate 34 is not used.

In operation, trash can 12 with device 10 mounted thereon is placed atop ground 14 with the bottom of base 30 abutting or closely adjacent ground 14. To anchor trash can 12 to ground 14, a downward force indicated at Arrow A is applied by a foot or shoe 118 to force spikes 82 and 84 into ground 14 (FIG. 1). As shown in FIG. 4, anchor 32 is in the raised position so that foot press member 90 and the upper ends 86 of spikes 82 and 84 are spaced upwardly of top edge 44 of mounting plate 42. In this position, tapered lower ends 88 of spikes 82 and 84 are adjacent the lower ends 78 of rails 58 and 60 and thus adjacent the lower ends of holes 80 as well as adjacent ground 14 although removed therefrom. The application of downward force on foot press member 90 forces spikes 82 and 84 into ground 14 so that lower ends 88 are disposed in a subsurface position which in the exemplary embodiment is approximately five inches below the surface of ground 14. The depth to which the lower ends 88 of spikes 82 and 84 must extend in the anchored position varies depending on the size of the trash can or other outdoor items and the climate and soil with which trash can 12 and device 10 are used. One embodiment of device 10 in which mounting plate 42 is approximately four inches wide and five inches high, and wherein spikes 82 and 84 are sunk into the ground with ends 88 approximately five inches below the surface thereof has been tested and found suitable for securing a standard size outdoor empty trash can in winds up to fifty miles per hour. Thus, although device 10 is relatively small and mounted adjacent the lower end of the trash can adjacent ground 14 when in use, it provides a substantial amount of stability to the trash can.

Figure 6:
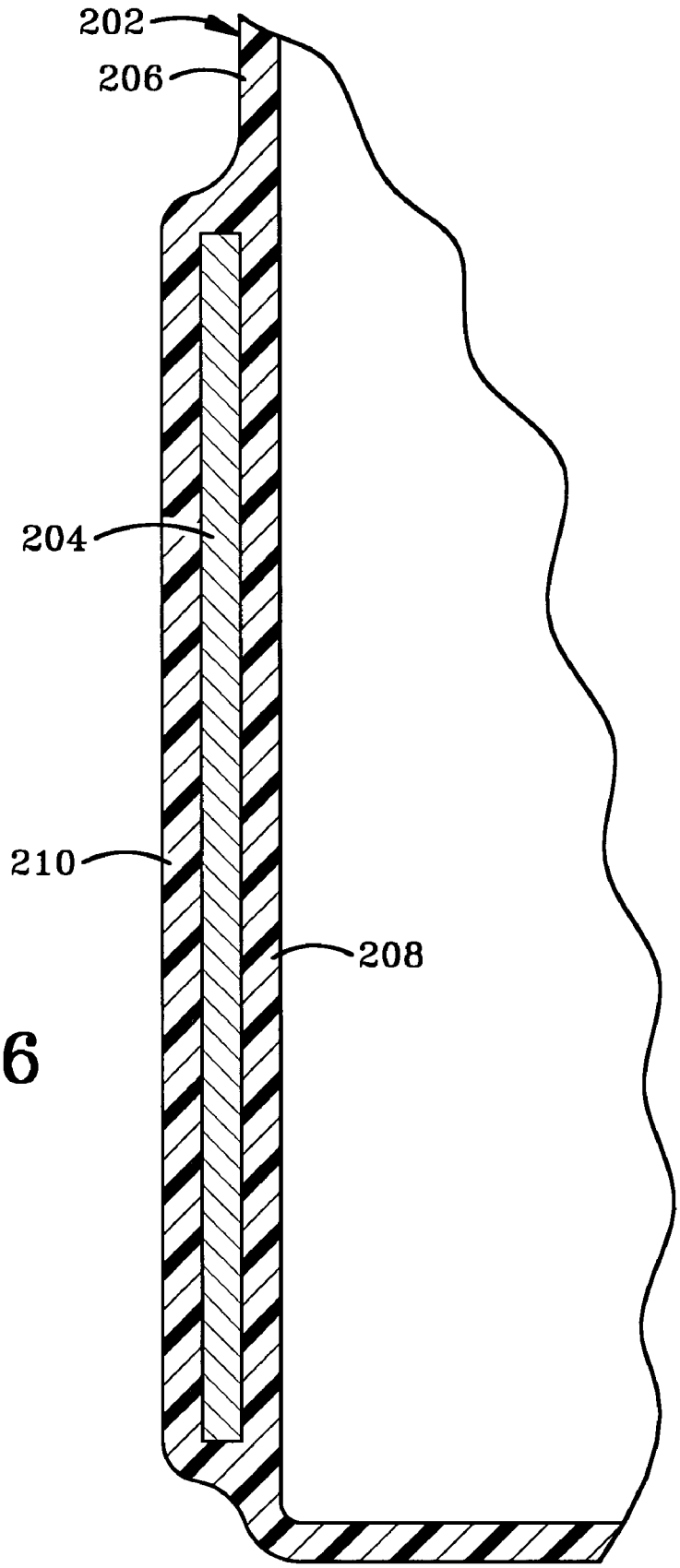
FIG. 6 is a sectional view taken on line 6-6 of FIG. 5.

Referring to FIGS. 5 and 6, anchoring device 200 is now described. Device 200 is a built-in anchoring device which is mounted on a trash can 202 without the use of fasteners such as bolts, nuts, rivets, and also without a reinforcing plate such as plate 34 of device 10. Device 200 is similar to device 10 in that it includes a base having a mounting plate 204 which is similar to plate 42 without the holes formed therethrough. In addition, device 200 is free of a flange such as flange 79 which is connected to plate 204 and extends laterally outwardly therefrom. Like device 10, device 200 includes rails 58 and 60 and anchor 32 and thus operates in the same fashion. In the exemplary embodiment of device 200, mounting plate 204 is molded into a sidewall 206 of trash can 204. More particularly, sidewall 206 adjacent its lower end includes an inner sidewall segment 208 and an outer sidewall segment 210 so that plate 204 is sandwiched therebetween. Thus, segments 208 and 210 are respectively in abutment with the inner and outer sides of plate 204. Sidewall segment 210 also contacts the top and bottom edges and the lateral edges of plate 204. Thus, outer segment 210 together with inner segment 208 defines a pocket within which mounting plate 204 is disposed. In device 200, sidewall 206 itself and in particular outer segment 210 serves as the mounting mechanism by which device 200 is mounted on trash can 202. While the exemplary embodiment shows that plate 204 is molded into sidewall 206, it is also contemplated that a sidewall similar to sidewall 206 may be formed with an outer sidewall segment to define a pocket having an entrance opening to allow a mounting plate such as plate 204 which is not molded into the sidewall to be slid into the pocket via the entrance opening and secured by any suitable mechanism therewithin.

With respect to the use on a trash can, devices 10 and 200 provide useful anchoring mechanisms which are easily applied by garbage collectors by simply stepping on the foot press member 90 to insert spikes 82 and 84 into the ground after trash has been emptied from the trash can. The owners of the trash can also fairly easily remove spikes 82 and 84 from the ground by applying an upward force on press member 90 directly or by tilting the trash can to create a prying motion. It is noted that foot press member 90 is spaced upwardly from ground 14 when in the anchoring position in order to provide access to its bottom surface to apply such an upward force for removing anchor 32 from ground 14. In addition, the owners may use anchoring device 30 to anchor the trash can when the trash can is full to help prevent its being tipped over due to windy conditions, animals and so forth. Conveniently, anchor 32 may be reset to the raised position simply by lowering the trash can with anchor 32 atop ground 14 or other support surface whereby the weight of the trash can, base and mounting mechanism typically causes the base to slide down relative to anchor 32. If the weight of the trash can or other outdoor item is not sufficient for this purpose, the user may apply an additional downward force on the trash can.

Devices 10 and 200 have been discussed herein in use with a trash can. However, device 10 or a similar structure may be used for temporarily anchoring other outdoor items such as garden equipment, hose reels, lawn chairs, dog or other pet carriers, grave blankets and so forth. Substantially smaller devices have been configured for use in various applications, for instance wherein the mounting plate 42 is about one and half inches wide and three inches high and the spikes of the anchor are configured to extend two or three inches into the soil. It is further noted that more than one anchoring device such as device 30 may be used on a given trash can or other item to be secured to the ground.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An anchoring mechanism for use with an outdoor item having a lower end adapted to sit on the ground, the anchoring mechanism comprising:

a base;

a mounting mechanism on the base adapted to mount the base on the outdoor item adjacent its lower end;

an anchor mounted on the base and movable between a raised position in which the anchor is adapted to be removed from the ground and a lowered anchoring position in which the anchor is adapted to be inserted into the ground to secure the outdoor item to the ground;

a first spike on the anchor which extends generally vertically, which in the raised position is adapted to be removed from the ground and which in the lowered anchoring position is adapted to be inserted into the ground; and a foot press member extending laterally outwardly from adjacent the first spike.

2. The anchoring mechanism of claim 1 further comprising a fastener extending outwardly from the base adapted to mount the base on the outdoor item.

3. The anchoring mechanism of claim 2 further comprising a reinforcing member spaced from the base; and wherein the fastener extends from the base to the reinforcing member to provide a connection therebetween.

4. The anchoring mechanism of claim 3 further comprising a convexly curved outer surface on the reinforcing member adapted to matingly engage a concavely curved inner surface of the outdoor item.

5. The anchoring mechanism of claim 1 further comprising a plate on the base which extends generally vertically; a bottom on the plate; and a horizontal flange extending outwardly from the plate adjacent its bottom.

6. The anchoring mechanism of claim 5 further comprising an upwardly extending concavely curved outer surface on the plate adapted to matingly engage a convexly curved outer surface on a trash can.

7. The anchoring mechanism of claim 5 in combination with the outdoor item; and wherein the horizontal flange extends beneath the lower end of the outdoor item.

8. The anchoring mechanism of claim 5 in combination with the outdoor item; and wherein the outdoor item is seated on the horizontal flange.

9. The anchoring mechanism of claim 1 further comprising a hole formed in the base; and wherein the first spike is slidable within the hole between the raised and lowered positions.

10. The anchoring mechanism of claim 9 further comprising an upwardly extending groove formed in the base vertically aligned with the hole.

11. The anchoring mechanism of claim 1 wherein the first spike and foot press member are formed as an integral one-piece member.

12. The anchoring mechanism of claim 11 wherein the spike and foot press member are formed from a bent rod.

13. The anchoring mechanism of claim 12 further comprising a reinforcing segment of the rod; a first bend in the rod connecting the spike and reinforcing segment; and a second bend in the rod connecting the foot press member and the reinforcing segment.

14. The anchoring mechanism of claim 1 wherein the foot press member extends laterally outwardly from the spike in a first direction; and further comprising a plate on the base which extends generally vertically; a bottom on the plate; and a flange extending outwardly from the plate adjacent its bottom in a second direction generally opposite the first direction.

15. The anchoring mechanism of claim 1 further comprising a second spike spaced from and parallel to the first spike and movable between the raised and lowered positions.

16. The anchoring mechanism of claim 1 further comprising first and second upwardly extending parallel rails on the base; first and second upwardly extending through holes formed respectively in the first and second rails and having respective upper ends; first and second grooves formed respectively in the first and second rails in communication with the respective upper ends of the holes and extending upwardly therefrom; and a second spike whereby the first and second spikes are first and second spaced and parallel upwardly extending spikes on the anchor which are slidably received respectively in the first and second holes and respectively in the first and second grooves to move between the raised and lowered positions.

17. The anchoring mechanism of claim 1 in combination with an outdoor trash can having a lower end; and wherein the base is mounted on the trash can adjacent its lower end; and the anchor extends below the lower end in the lowered position.

18. The combination of claim 17 wherein the trash can, base and mounting mechanism together have a weight; and the anchor when seated atop a supporting surface is movable from the lowered position to the raised position as a result of downward movement of the trash can, base and mounting mechanism caused by said weight.

19. An anchoring mechanism for use with an outdoor item having a lower end adapted to sit on the ground, the anchoring mechanism comprising:

a base;

a mounting mechanism on the base adapted to mount the base on the outdoor item adjacent its lower end;

an anchor mounted on the base and movable between a raised position in which the anchor is adapted to be removed from the ground and a lowered anchoring position in which the anchor is adapted to be inserted into the ground to secure the outdoor item to the ground;

a first spike on the anchor which extends generally vertically, which in the raised position is adapted to be removed from the ground and which in the lowered anchoring position is adapted to be inserted into the ground;

a second spike spaced from and parallel to the first spike and movable between the raised and lowered positions; and a foot press member extending laterally outwardly from the spikes.

20. An anchoring mechanism for use with an outdoor item having a lower end adapted to sit on the ground, the anchoring mechanism comprising:

a base;

a mounting mechanism on the base adapted to mount the base on the outdoor item adjacent its lower end;

an anchor mounted on the base and movable between a raised position in which the anchor is adapted to be removed from the ground and a lowered anchoring position in which the anchor is adapted to be inserted into the ground to secure the outdoor item to the ground;

a plate on the base which extends generally vertically;

a bottom on the plate; and a horizontal flange extending outwardly from the plate adjacent its bottom.

21. The anchoring mechanism of claim 20 further comprising a first spike on the anchor which extends generally vertically, which in the raised position is adapted to be removed from the ground and which in the lowered anchoring position is adapted to be inserted into the ground.

22. The anchoring mechanism of claim 20 in combination with the outdoor item; and wherein the horizontal flange extends beneath the lower end of the outdoor item.

23. The anchoring mechanism of claim 20 in combination with the outdoor item; and wherein the outdoor item is seated on the horizontal flange.

* * * * *